US012791043B2

(12) United States Patent
Bredwad

(10) Patent No.: US 12,791,043 B2
(45) Date of Patent: Nov. 10, 2026

(54) SUBMERSIBLE SEMI-AXIAL CENTRIFUGAL PUMP

(71) Applicant: Xylem Europe GmbH, Schaffhausen (CH)

(72) Inventor: Viktor Bredwad, Spånga (SE)

(73) Assignee: Xylem Europe GmbH, Schaffhausen (CH)

( * ) Notice: Subject to any disclaimer, the term of this patent is extended or adjusted under 35 U.S.C. 154(b) by 0 days.

(21) Appl. No.: 19/412,961

(22) Filed: Dec. 9, 2025

(65) Prior Publication Data

US 2026/0160269 A1 Jun. 11, 2026

(30) Foreign Application Priority Data

Dec. 10, 2024 (EP) ..... 24218555

(51) Int. Cl.
*F04D 29/62* (2006.01)
*F04D 7/04* (2006.01)
*F04D 13/08* (2006.01)

(52) U.S. Cl.
CPC ..... *F04D 29/622* (2013.01); *F04D 7/04* (2013.01); *F04D 13/08* (2013.01)

(58) Field of Classification Search
CPC .. F04D 29/4293; F04D 29/007; F04D 29/406; F04D 29/426; F04D 29/4273;
(Continued)

(56) References Cited

U.S. PATENT DOCUMENTS 5,951,244 A * 9/1999 Knight, Sr. ..... F04D 29/622 411/383
6,368,053 B1 * 4/2002 Knight, Sr. ..... F04D 29/622 411/383

(Continued)

FOREIGN PATENT DOCUMENTS

CN 201437781 U * 4/2010 ..... F04D 29/622
EP 1906026 A1 4/2008

(Continued)

*Primary Examiner* — Thomas Fink
(74) *Attorney, Agent, or Firm* — The Webb Law Firm

(57) ABSTRACT

The invention relates to a submersible semi-axial centrifugal pump for installation in a column, and includes an outer pump housing and an inner pump core arrangement. The pump core arrangement includes a drive unit, a semi-axial open centrifugal impeller and a plurality of guide vanes extending between and connecting the pump housing and the drive unit, wherein the impeller includes a hub and at least two spirally swept blades, wherein the hub is essentially cone-shaped tapering towards the inlet of the pump housing. Each blade includes a leading edge, a trailing edge and a lower edge. The outer pump housing includes a diffuser, connected to the stationary drive unit via the radially extending guide vanes, and an inlet funnel, fixedly connected to the diffuser, wherein the semi-axial centrifugal pump includes a pump housing liner, located between the outer pump housing and the lower edge of the impeller, wherein the pump housing liner is displaceable in the axial direction in relation to the outer pump housing in order to adjust a radial gap between the pump housing liner and the lower edge of the impeller.

9 Claims, 7 Drawing Sheets

(58) Field of Classification Search
CPC ..... F04D 29/622; F04D 29/642; F04D 1/04; F04D 1/00; F04D 1/14; F04D 3/00–005; F04D 13/08–086
See application file for complete search history.

(56) References Cited

U.S. PATENT DOCUMENTS

| | | | | |
|---|---|---|---|---|
| 10,400,778 | B2 * | 9/2019 | Garvin | F04D 29/167 |
| 2014/0363273 | A1 | 12/2014 | Burman | |
| 2015/0292519 | A1 * | 10/2015 | Stark | F04D 29/622<br>415/126 |
| 2016/0169247 | A1 * | 6/2016 | Klein | F04D 29/167<br>415/214.1 |

FOREIGN PATENT DOCUMENTS

| | | | | |
|---|---|---|---|---|
| KR | 101130708 | B1 * | 4/2012 | F16B 5/02 |
| KR | 20160002114 | A * | 1/2016 | F04D 13/08 |
| KR | 102046318 | B1 * | 11/2019 | F04D 29/406 |

* cited by examiner

SUBMERSIBLE SEMI-AXIAL CENTRIFUGAL PUMP

CROSS-REFERENCE TO RELATED APPLICATION

This application claims priority to European Patent Application No. 24218555.1 filed Dec. 10, 2024, the disclosure of which is hereby incorporated by reference in its entirety.

BACKGROUND OF THE INVENTION

Field of the Invention

The present invention relates generally to the field of submersible semi-axial centrifugal pumps that are configured for pumping liquid comprising solid/fibrous matter. A submersible semi-axial centrifugal pump is normally used to transport large amounts of screened sewage/wastewater, stormwater, drainage water, etc., a rather limited height, e.g. about 2000 litre/second about 20 meters during rated/nominal operational speed. A submersible semi-axial centrifugal pump is normally arranged lowered into a rigid column extending from a first/lower basin/volume to a second/upper basin/volume.

In particular, the present invention relates to a submersible semi-axial centrifugal pump for installation in a column and configured for pumping liquid comprising solid matter. Wherein the pump comprises:

- an outer pump housing having an axial inlet and an axial outlet, and
- an inner pump core arrangement, comprising:
  - a stationary drive unit surrounded at least partly by the pump housing,
  - a semi-axial open centrifugal impeller that is suspended from the drive unit and located adjacent the inlet of the pump housing, and
  - a plurality of guide vanes extending between and connecting the pump housing and the drive unit of the pump core arrangement, wherein the impeller comprises a hub and at least two spirally swept blades connected to the hub and extending in the radial direction from the hub, wherein the hub is essentially cone-shaped tapering towards the inlet of the pump housing, each blade comprising a leading edge facing the inlet of the pump housing, a trailing edge facing the outlet of the pump housing and a lower edge, wherein the lower edge extends from the leading edge to the trailing edge.

wherein the outer pump housing comprises:

- a diffuser, connected to the stationary drive unit via the radially extending guide vanes, wherein the diffuser comprises the outlet of the pump, and
- an inlet funnel, fixedly connected to the diffuser, wherein the inlet funnel comprises the inlet of the pump, wherein the semi-axial centrifugal pump comprises a pump housing liner, located between the outer pump housing and the lower edge of the impeller, wherein the pump housing liner is displaceable in the axial direction in relation to the outer pump housing in order to adjust a radial gap between the pump housing liner and the lower edge of the impeller.

Description of Related Art

In some types of liquid handling, for instance transport of large volumes of contaminated water comprising solid matter, i.e. sewage/wastewater, stormwater, drainage water, etc., a submersible semi-axial centrifugal pump presents a number of advantages in relation to conventional axial propeller pumps which are usually intended for clean water or lightly contaminated water.

Conventional semi-axial centrifugal pumps are designed to have the advantages of a centrifugal pump in terms of efficiency and pressure and the ability to pump contaminated water, while at the same time allowing a discharge flow in the axial direction like an axial propeller pump. Thus, the pump is designed to guide the liquid in an outward spiral in a mixture of radial/axial direction from the impeller towards the pump housing in order to increase the pressure by centrifugal action and thereafter guide vanes are used to redirect the liquid flow from rotating to axial in order to recover static pressure to the liquid flow leaving the pump housing. The inlet of the semi-axial centrifugal pump and the outlet of the pump are facing in the axial direction. Such semi-axial centrifugal pumps may also be called mixed-flow pumps.

Semi-axial centrifugal pumps are arranged lowered into a column and are typically installed downstream screens and are thus protected from fibrous matter, wet wipes, textiles, facemasks, etc., that are prone to clog the pump and impeller by clinging to the leading edges of the impeller. Conventional semi-axial centrifugal pumps comprise either closed impellers or open impellers, and the impellers are essentially designed/optimized for maximized pumping performance. However, pumps comprising open impellers are also subject to defective efficiency due to inadequate gap between the lower edge of the impeller and the inner surface of the outer pump housing.

The inadequate gap is either present already upon assembly due to poor accuracy of the assembler, or the inadequate gap arise during operation due to wear of the lower edge of the blades of the impeller due to abrasive solid matter, such as sand and stones. For a semi-axial centrifugal pump, the radial gap between the impeller and the pump housing is directly dependent on the mutual axial position of the impeller and pump housing, respectively. Conventionally, the gap between the impeller and the pump housing can only be inspected/measured when the pump is completely assembled and arranged vertical in its operational orientation. If the gap is too large, the pump is disassembled and shims are used to adjust the location of the impeller, and thereafter the pump is reassembled, and the gap is once more inspected/measured. Due to the cumbersomeness the assembler does not want to perform a second adjustment and therefore provide a wider gap than optimal during the first adjustment, but this entails poor efficiency/performance.

There have been attempts in the technical field to provide semi-axial pumps, wherein the radial gap between the impeller and the pump housing is adjustable without having to disassemble the pump. However, such attempts require that the pump is arranged horizontally during adjustment, wherein the location of the entire inlet funnel is adjusted in the axial direction in relation to the pump housing. Such adjustment is extremely difficult since the inlet funnel and the pump housing are heavy elements, and it is more or less impossible to feel when the inlet funnel abuts the impeller or not during adjustment. Thereto the drive shaft and impeller are slightly movable in the axial direction in relation to the pump housing, and when the pump is in the horizontal orientation it is impossible to know whether the impeller is in the operational position or not.

Thus, the is a need in the present technical field for a semi-axial centrifugal pump configured to pump unscreened liquid comprising solid matter, wherein the radial gap between the impeller and the pump housing is adjustable without having to disassemble the pump.

SUMMARY OF THE INVENTION

The present invention aims at obviating the aforementioned disadvantages and failings of previously known semi-axial centrifugal pumps, and at providing an improved semi-axial centrifugal pump.

A primary object of the present invention is to provide an improved semi-axial centrifugal pump, configured to allow adjustment of the radial gap between the impeller and the pump housing without having to disassemble the pump. It is another object of the present invention to provide an improved semi-axial centrifugal pump, configured to allow adjustment of the radial gap between the impeller and the pump housing without having to inspect/measure/verify the radial gap between the impeller and the pump housing.

According to the invention at least the primary object is attained by means of the initially defined pump having the features described herein. Preferred embodiments of the present invention are further defined herein.

According to the present invention, that the pump housing liner comprises a radially extending flange and the diffuser comprises a transversal surface located opposite said radially extending flange,

- the pump housing liner being displaceable in the axial direction in relation to the outer pump housing by means of axially adjustable attachment means that are in threaded engagement with the diffusor at the transversal surface and that are accessible and manipulatable via openings in the inlet funnel,
- the adjustable attachment means comprising a plurality of adjustment screws and a plurality of locking screws, wherein the radially extending flange is clamped between the head of the adjustment screws and the head of the locking screws,
  - wherein the maximum distance between the transversal surface and the radially extending flange is defined by the locking screws, and
  - wherein the minimum distance between the transversal surface and the radially extending flange is defined by the adjustment screws.

Thus, the present invention is based on the insight that the conventional gap-adjustment procedure using shims and the multiple assembly-disassembly of the pump is not efficient enough, and the inlet funnel is too heavy to be able to perform an adequate adjustment of the gap between the impeller and the pump housing. The inventor has taken this into consideration and proposed the present invention that entails that a light liner element, pump housing liner, is easily adjusted with great accuracy without the need to disassembly or loosen the inlet funnel, and thereto the pump may be in the operational upright orientation during the adjustment.

According to various embodiments of the present invention, the upper end of the pump housing liner is in telescopic arrangement with the diffuser, and/or the lower end of the pump housing liner is in telescopic arrangement with the inlet funnel. Thereby proper alignment of the pump housing liner is provided, independently of the axial location of the pump housing liner in relation to the pump housing.

According to various embodiments of the present invention, the pump housing liner is connected to the lower end of the diffuser by means of axially adjustable attachment means. By connecting the pump housing liner to the diffuser, the line of tolerance is made as short as possible since the location of the impeller is also defined with reference to the diffuser.

According to the present invention, the pump housing liner is displaceable in the axial direction in relation to the outer pump housing by means of axially adjustable attachment means, wherein said axially adjustable attachment means are accessible and manipulatable via openings in the inlet funnel. Thereby, the pump housing liner is easily adjusted with great accuracy without the need to disassembly or loosen the inlet funnel.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DESCRIPTION OF THE INVENTION

Figure 1:
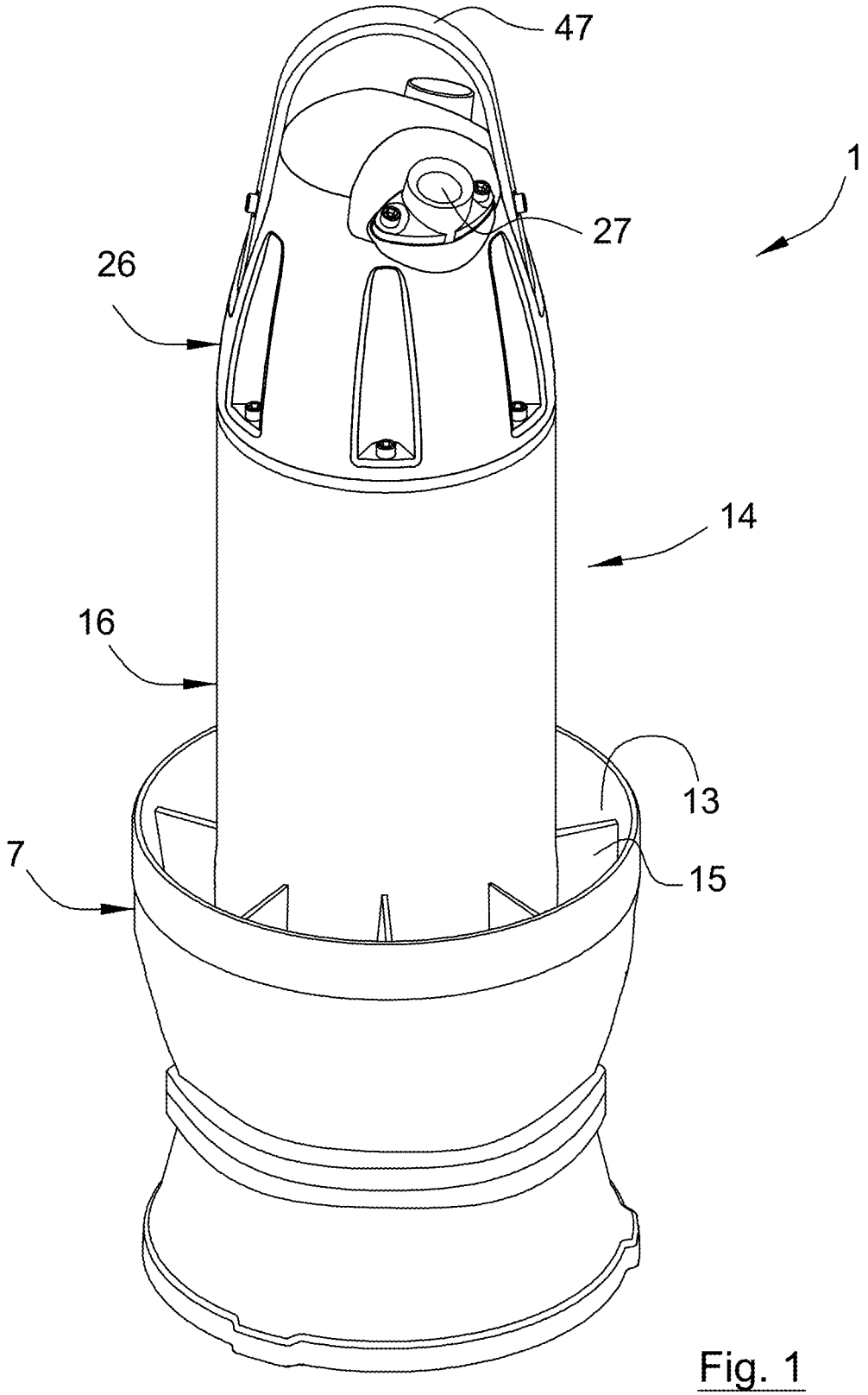
FIG. 1 is a schematic perspective view from above of a semi-axial centrifugal pump.
Figure 2:
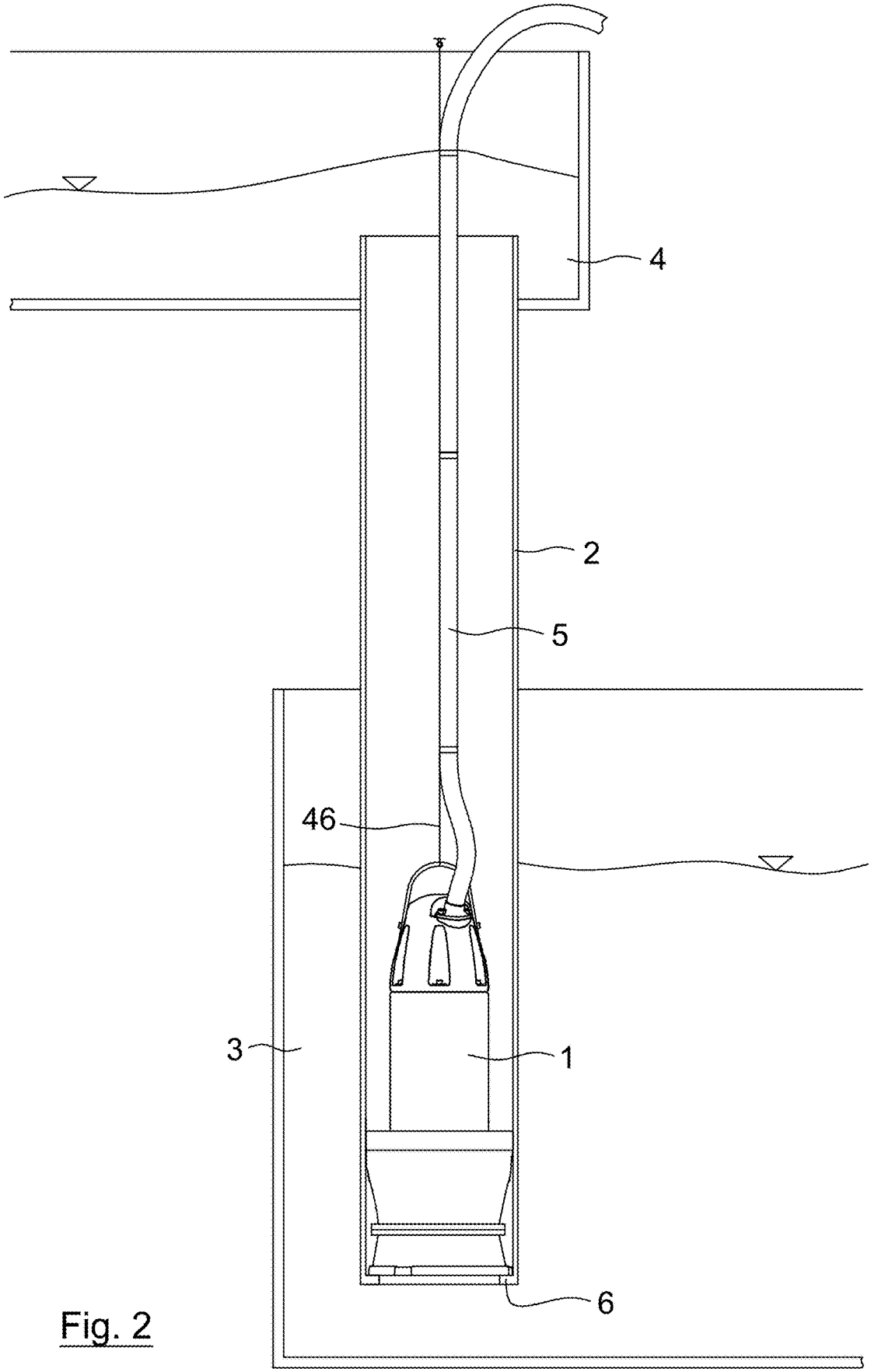
FIG. 2 is a schematic cross-sectional side view of a pump station comprising a semi-axial centrifugal pump according to FIG. 1.

Reference is initially made to FIGS. 1 and 2. The present invention relates generally to a submersible semi-axial centrifugal pump, generally designated 1, that is configured for pumping liquid comprising solid/fibrous matter, such as sewage/wastewater, stormwater, drainage water, etc. Semi-axial centrifugal pumps 1 are generally arranged to transport large amounts of liquid a rather limited height, e.g. about 2000 litre/second about 20 meters during rated/nominal operational speed. The semi-axial pump 1 according to the present invention is designed to have a specific speed [$n_q$] that is in the range 80-160, preferably in the range 100-120. The specific speed [$n_q$] is determined as [$n_q = n*Q^{(1/2)}/H^{(3/4)}$], wherein n=the nominal rotational speed of the propeller pump (rpm), Q–the pumped liquid flow (m2/sec), and H=the pressure head of the pumped liquid (m).

In FIG. 1 a perspective view from above of a semi-axial pump 1 according to the invention is disclosed, and FIG. 2 disclose a part of a schematic pump station that comprises one or more semi-axial pumps 1, each pump 1 being arranged at a lower end of a column 2. According to the disclosed embodiment, the column 2 extends from a lower basin 3 to an upper basin 4, with the purpose of transporting liquid from the lower basin 3 to the upper basin 4. It should be pointed out that the axial length of the column 2 usually is several times greater than the axial height of the pump 1, and that the pump 1 and the column 2 are concentrically arranged in relation to each other. The pump 1 is connected to one or more cables 5 for the power supply and possible signal transfer, which cables 5 run from the pump 1, via the inside of the column 2, up to a power source and/or to a control unit (not shown).

Figure 3:
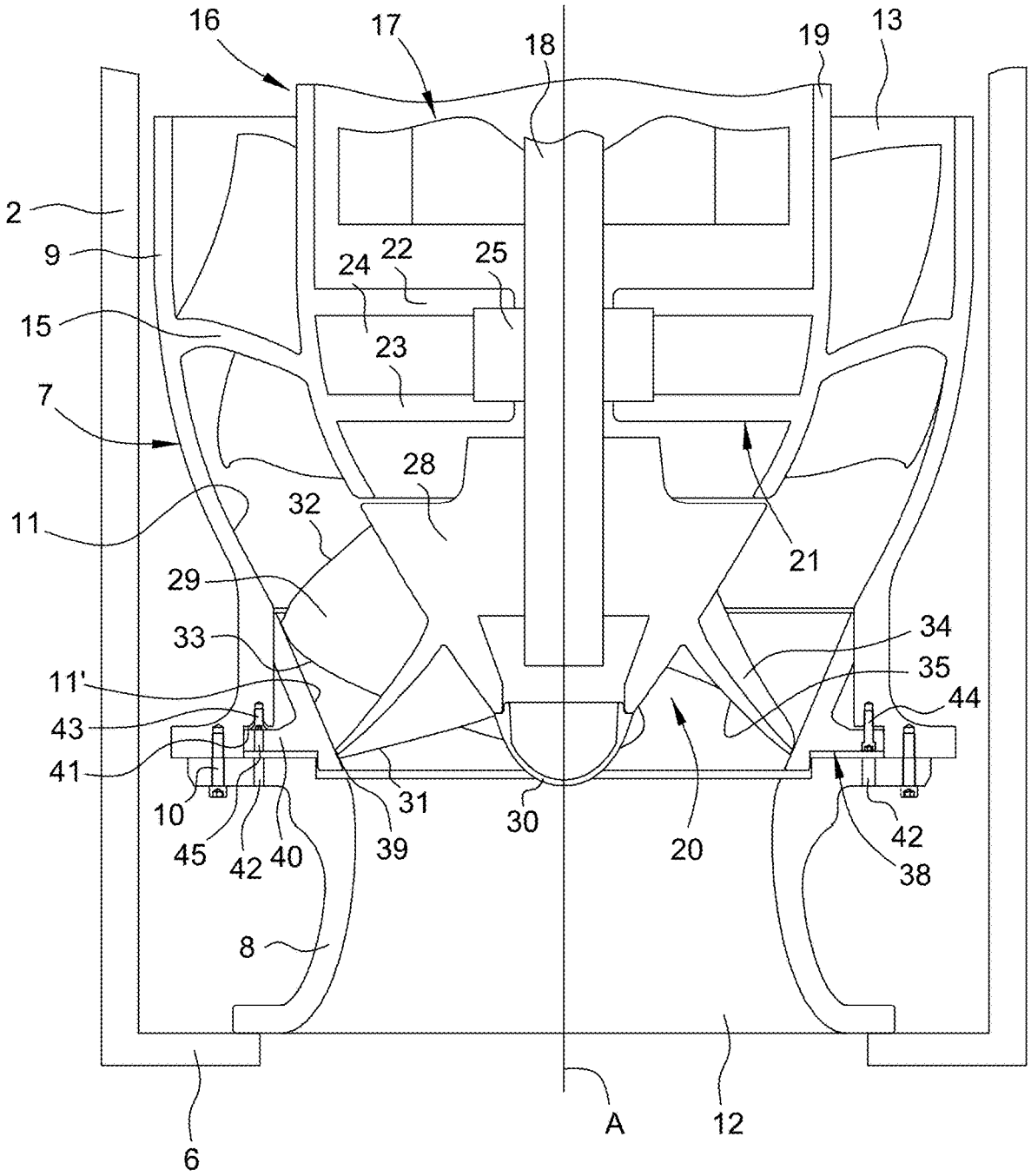
FIG. 3 is a schematic cross-sectional side view of a part of the semi-axial centrifugal pump according to a first embodiment.

Reference is now also made to FIG. 3, disclosing a schematic cross-sectional side view of the lower part of the semi-axial centrifugal pump 1 according to a first embodiment and of the lower end of the column 2, i.e. parts of the pump 1 and the column 2 are removed. Thus, the pump 1 is normally intended to be placed in a column 2 that is partly lowered into the pumped media. During installation, the semi-axial centrifugal pump 1 is lowered into the column 2 until it stands on a bottom flange 6 in the column 2 and thereby seals tightly against the column 2. Consequently, the pump 1 is entirely or partly submersed into the media when it has reached its operational position. During operation, the column 2 also works as an outlet pipe for the pumped liquid. Before any service to the pump 1, such as trimming of the pump, the pump 1 is hoisted and removed from the column 2.

The inventive semi-axial centrifugal pump 1 comprises an axially extending outer pump housing, generally designated 7. The outer pump housing 7 is essentially tubular, and comprises in the disclosed embodiment an inlet funnel 8 and a diffuser 9, which are interconnected in an axial interrelationship. According to various embodiments, the inlet funnel 8 and the diffuser 9 are fixedly connected to each other by means of a plurality of axially extending connection screws 10. Thus, the inlet funnel 8 may be detached from the diffuser 9 by loosening the connection screws 10, but when the pump 1 is assembled the inlet funnel 8 and the diffuser 9 are in direct and fixed contact with each other. Thus, the pump 1 has always the same height.

The pump housing 7 has an inner surface 11 and comprises furthermore an axial inlet opening 12 situated at the region of the lower/upstream end of the inlet funnel 8 and an axial outlet opening 13 situated at the region of the upper/downstream end of the diffuser 9. Thus the inner surface 11 of the pump housing 7 extends from the inlet 12 to the outlet 13. The pump 1 is arranged to be lowered down into the column 2, and thereby the pump 1 has a somewhat smaller outer diameter than an inner diameter of the column 2. Thereby, a gap arises between an external surface of the pump housing 7 and an inner surface of the column 2. In order to prevent reflow of the pumped liquid down through said gap, i.e. via the space situated between the inner surface of the column 2 and an outer surface of the pump housing 7, the pump housing 7 rests on and closes tightly against the radially inwardly extending bottom flange 6 arranged at the lower end of the column 2. Said space between the column 2 and the pump 1 may be filled with water and solids without having negative effect on the operation of the pump 1. According to various embodiments the lower surface of the pump 1 is abutting the flange 6. However, other flanges of the pump 1 may serve as abutment surface, such as the flange at the interface between the diffuser 9 and the inlet funnel 8.

Figure 6:
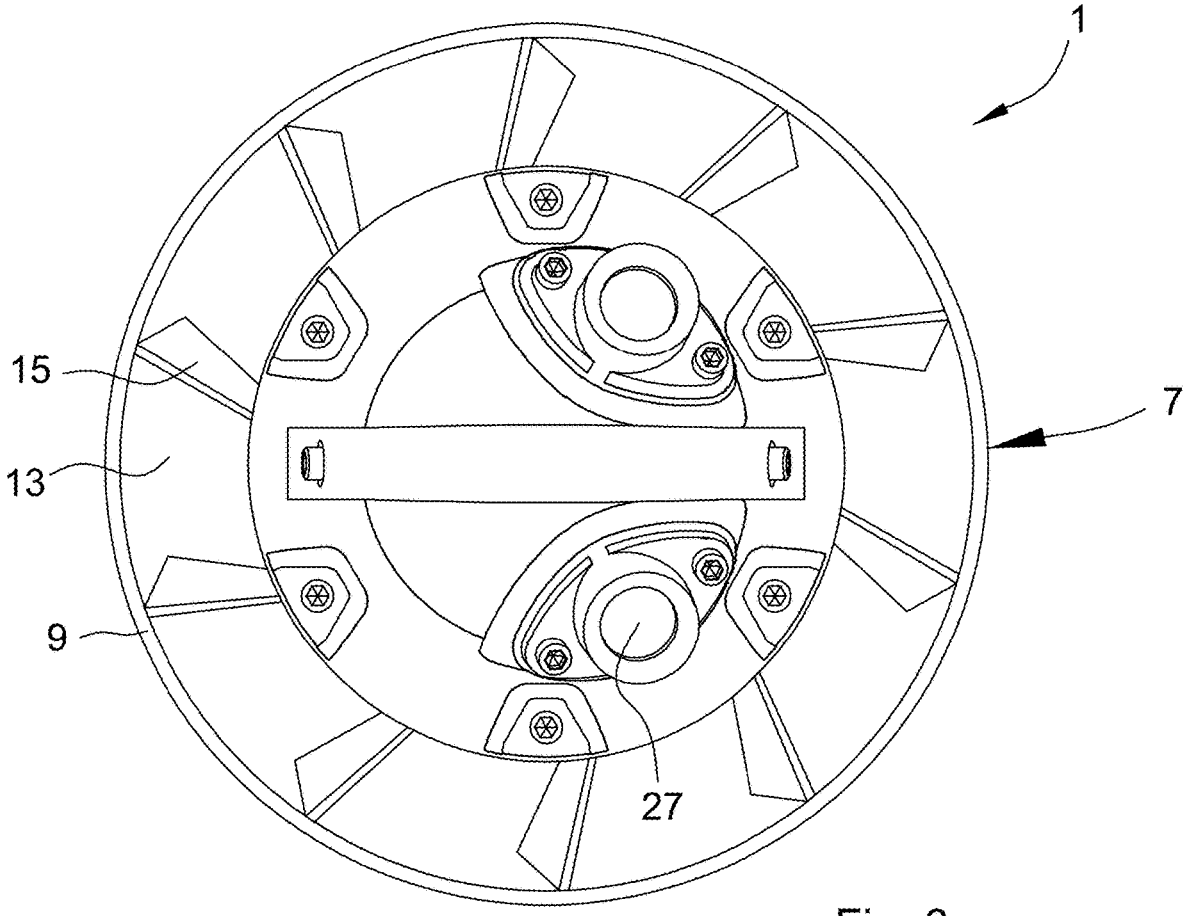
FIG. 6 is a schematic view from above of the semi-axial centrifugal pump according to FIG. 1.

Furthermore, the semi-axial centrifugal pump 1 according to the invention comprises an axially extending inner pump core arrangement, generally designated 14. The lower part of the pump core arrangement 14 is surrounded by the pump housing 7, i.e. by the diffuser 9 in the disclosed embodiment, and the upper part of the pump core arrangement 14 is surrounded by the column 2 when the pump 1 is in the mounted state in the column 2. Thus, the pump core arrangement 14 has an axial height that is greater than the axial height of the pump housing 7. Preferably, the axial height of the pump core arrangement 14 is at least twice as large as the axial height of the pump housing 7. In other words, the pump housing 7 and the pump core arrangement 14 are arranged overlapping each other in the axial direction, at the same time as the pump core arrangement 14, in the radial direction, is situated at a distance from the inner surface 11 of the pump housing 7. Preferably, the pump core arrangement 14 and the pump housing 7 are concentrically arranged in relation to each other. In addition, the pump 1 according to the invention comprises a plurality of radially extending guide vanes 15, which are connected to the inner surface 11 of the pump housing 7 and to the envelope surface of the pump core arrangement 14. Preferably, the pump 1 comprises ten or more such guide vanes 15, which are equidistantly arranged along the circumference of the pump core arrangement 14. Reference is also made to FIG. 6, which disclose a view from above of a pump 1 according to the invention.

The inner pump core arrangement 14 comprises a drive unit, generally designated 16, which comprises an electric motor 17 and a drive shaft 18 extending from said motor in the axial direction. The motor 17 is directly or indirectly connected to the power supply cable 5, which extends from an external power supply. Preferably, the drive unit 16 comprises an axially extending tubular motor housing 19. The guide vanes 15 extend between the motor housing 19 of the drive unit 16 and the pump housing 7. Furthermore, the pump core arrangement 14 comprises semi-axial open centrifugal impeller 20 that is suspended from the drive unit 16, i.e. from the lower end of the drive shaft 18. The impeller 20 is located adjacent the inlet 12 of the pump housing 7. The impeller 20 is located radially inside the diffuser 9 in the disclosed embodiment.

The pump core arrangement 14 further comprises a liquid seal unit 21 configured to separate the volume that houses the impeller 20 and the liquid tight motor compartment that houses the motor 17 from each other in a liquid tight manner, i.e. in order to protect the motor 17 from the pumped liquid. The liquid seal unit 21 is surrounded by the motor housing 19, an upper wall 22 that is called oil housing cover and a lower wall 23 that is called oil housing bottom, which together define a chamber 24 accommodating a liquid, preferably an oil. The liquid seal unit 21 forms a seat for a drive shaft sealing assembly 25, also known as sealing cartridge, which is schematically disclosed and which comprises an outer mechanical face seal that prevents the pumped liquid from leaking into the chamber 24 and an inner mechanical face seal that prevents the liquid in the chamber 24 from leaking into the motor compartment. Instead of said mechanical face seals, the drive shaft sealing assembly 25 may comprise other types of suitable seals, and alternatively the liquid seal unit 21 may comprise other type of sealing solution than said drive shaft sealing assembly.

Furthermore, in the shown embodiment, the pump core arrangement 14 comprises a pump top, generally designated 26, in which internal power supply to the motor 17 and external power supply via the power supply cable 5 are interconnected. The pump top 26 comprises liquid tight lead-through 27 receiving the electric power cable 5. Preferably, the pump top 26 has a truncated conical shape in order to minimize the emergence of regions having a rearwardly directed/negative flow rate in the column 2 directly downstream the pump top 26.

According to various embodiments, the pump 1, more precisely the electric motor 17, is operatively connected to a control unit, such as an Intelligent Drive comprising a Variable Frequency Drive (VFD). Thus, said pump 1 is configured to be operated at a variable operational speed [rpm], by means of said control unit. According to various embodiments, the control unit is located in an electronics chamber of the pump top 26, i.e. it is preferred that the control unit is integrated into the pump 1. The pump top 26, i.e. the electronics/connection chamber, is separated from the motor compartment in a liquid tight manner. The control unit is configured to control the operational speed of the pump 1. According to alternative embodiments the control unit is an external control unit, or the control unit is divided into an external sub-unit and an internal sub-unit. The operational speed of the pump 1 is more precisely the rpm of the electric motor 17 and of the impeller 20 and corresponds to the output frequency of the control unit.

The components of the pump 1 are cold down by means of the liquid/water surrounding the pump 1.

The semi-axial open centrifugal impeller 20 comprises a hub 28 and at least two spirally swept blades/vanes 29 that are connected to and extends in the radial direction from said hub 28. Said hub 28 is essentially cone-shaped and tapering in the direction towards the inlet 12 of the pump housing 7. The envelope surface of the hub 28, at the downstream end of the impeller 20, is aligned with the envelope surface of the motor housing 19 of the drive unit 16. At the upstream end of the impeller 20, the hub 28 comprises a spherical top 30 free from blades 29. The spherical hub top 30 is preferably removable in order to gain access to the drive shaft 18, i.e. in order to connect the impeller 20 to the lower end of the drive shaft 18 in a conventional way, for instance by means of a screw arrangement.

Each blade 29 comprises a leading edge 31 facing the inlet 12 of the pump housing 7, a trailing edge 32 facing the outlet 13 of the pump housing 7 and a lower edge 33, wherein the lower edge 33 extends from the leading edge 31 to the trailing edge 32 and wherein the lower edge 33 is located adjacent the inner surface 11 of the pump housing 7. The lower edge 33 separates a pressure side 34 of the blade 29 and a suction side 35 of the blade 29 from each other.

Figure 4:
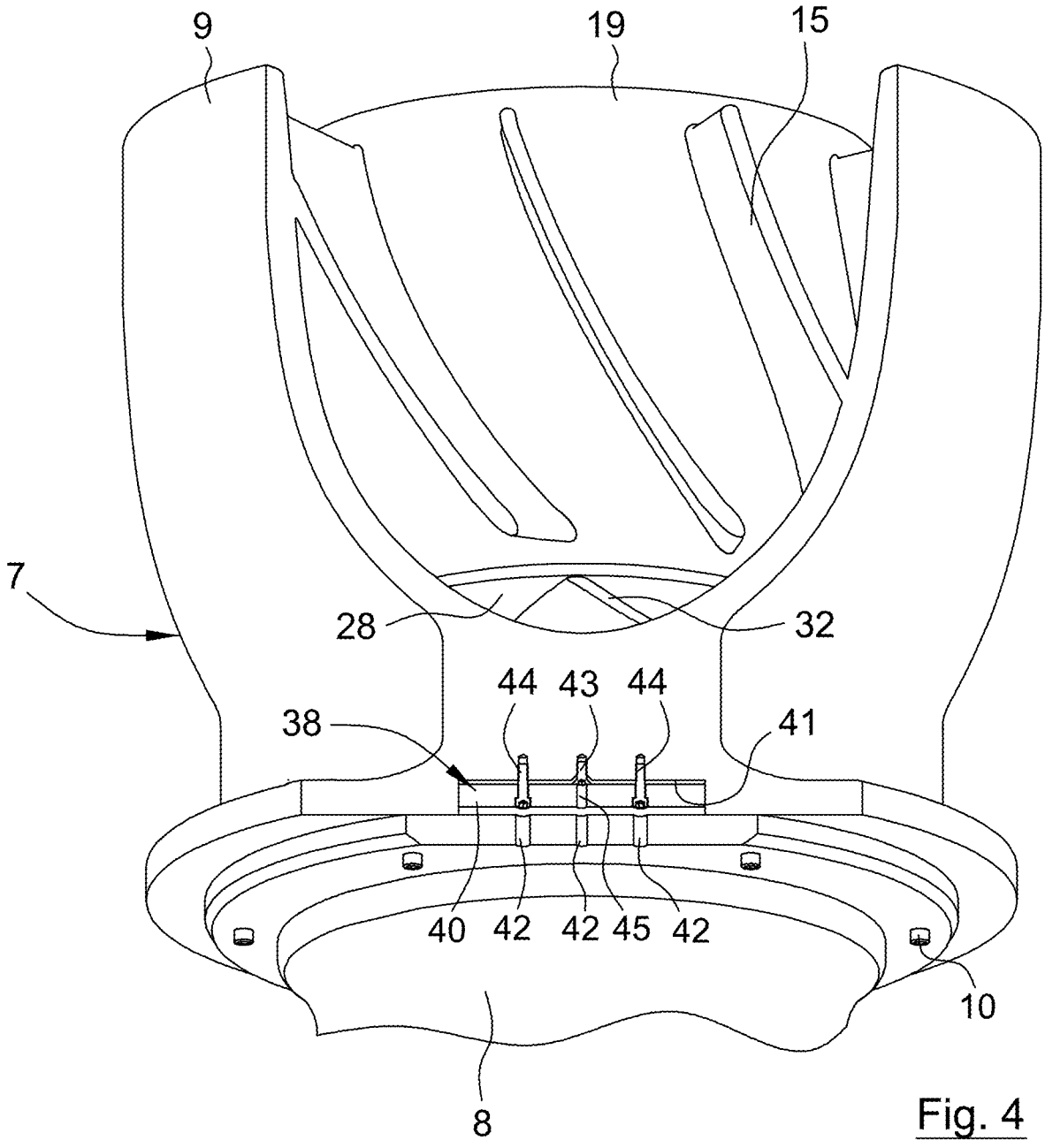
FIG. 4 is a schematic perspective cross-sectional view from below of a part of the semi-axial centrifugal pump according to FIG. 3.
Figure 5:
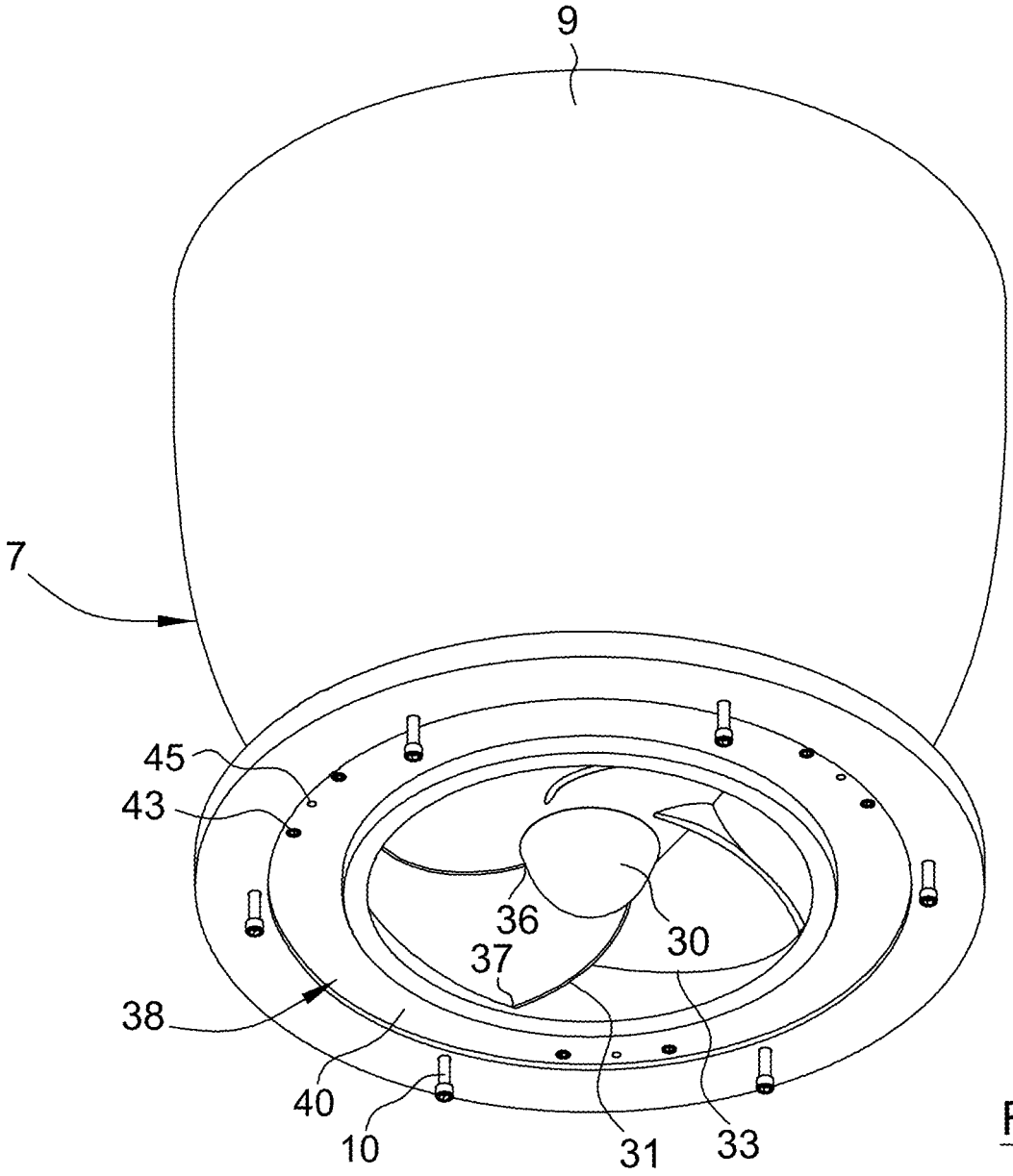
FIG. 5 is a schematic perspective view from below of the hydraulic unit of the semi-axial centrifugal pump according to FIG. 3.

Each blade 29 extends toward the inner surface 11 of the pump housing 7, and a narrow gap separates said blades 29 and the inner surface 11 of the pump housing 7. Said gap is preferably equal to or more than 0.05 mm and equal to or less than 2 mm. Preferably, the impeller 20 comprises three or four blades 29, which are equidistantly arranged along the circumference of the hub 28. Reference is also made to FIGS. 4 and 5, which disclose the diffuser 9 and wherein the inlet funnel 8 is removed for sake of clarity. The blades 29 are spirally swept from the leading edge 31 to the trailing edge 32, i.e. in a direction opposite the direction of rotation of the impeller 20 during normal (liquid pumping) operation of the pump 1.

According to the invention, the leading edge 31 of each blade 29 of the impeller 20 is swept backwards from an inner end 36 located at the hub 28 towards an outer end 37 located at the inner surface 11 of the pump housing 7. A centre axis (A) of the impeller 20 is located at a relative radius R* equal to 0 and the outer end 37 of the leading edge 31 of each blade 29 of the impeller 20 is located at a relative radius R* equal to 1. The leading edge 31 has a sweep angle ($\alpha$) that defines the design/configuration of the upstream end of the blades 29, such that any solid matter that is caught over the leading edge 31 is automatically guided outwards towards the outer end 37 of the leading edge 31. The rotational speed at the outer end 37 of the leading edge 31 is greater than the rotational speed at the inner end 36 of the leading edge 31, and thereby it is much more likely that the solid matter will slide off the leading edge 31 when guided outwards.

The inner end 36 of the leading edge 31 of each blade 29 of the impeller 20 is located at a relative radius R* that is equal to or more than 0.25 and equal to or less than 0.45, preferably equal to or less than 0.35. A smaller value of the relative radius R* entails that the attachment of the impeller 20 to the drive shaft 18 is made more complicated and having the leading edge 31 extended further inwards will have limited or negligible effect on the overall pumping performance. A larger value of the relative radius R* entails that the top of the hub 28 becomes too large and increased risk of having solid matter caught over the top of the hub 28.

According to various embodiments of the present invention, the leading edge 31 has an inclination/tilt in the axial direction, i.e. a tilt angle ($\beta$). The tilt angle ($\beta$) of the leading edge 31 is located in an axial plane (P1) that is parallel to the centre axis (A) of the impeller 20. Said axial plane (P1) usually do not comprise the centre axis (A). The tilt angle ($\beta$) is defined between:

- a tilt line extending between the inner end 36 of the leading edge 31 and the outer end 37 of the leading edge 31, and
- the transversal plane (P2) of the pump 1, wherein the tilt angle ($\beta$) is in the range 0-35 degrees, and wherein the outer end 37 of the leading edge 31 is located upstream the inner end 36 of the leading edge 31.

It shall be pointed out that the tilt angle ($\beta$) in some embodiments may be negative, i.e. in the range −15-0 degrees, wherein the outer end 37 of the leading edge 31 is located downstream the inner end 36 of the leading edge 31.

According to the various embodiments of the present invention, reference to FIGS. 1-2, a wire 46, is connected to a lifting handle 47, which in turn is connected with the pump top 26. Via the inside of the column 2, the wire 46 is running up to a fixing point situated above the column 2, preferably, the extension of the wire 46 coincides with an extension of the centre line of the pump 1. Furthermore, the at least one power supply cable 5 of the pump 1 leaves the pump top 26 and is then attached to the wire 46 and runs along the wire 46 up to a level above the column 2. The object of attaching the power supply cable 5 to the wire 46 is that a free-hanging power supply cable will be influenced by a rotary component of velocity in the liquid flow in the column 2, and thereby risk being turned around and worn into pieces against the inner surface of the column 2.

According to the present invention, the semi-axial centrifugal pump 1 comprises a pump housing liner 38, located between the outer pump housing 7 and the lower edge 33 of the impeller 20, wherein the pump housing liner 38 is displaceable in the axial direction in relation to the outer pump housing 7 in order to adjust a radial gap 39 between the pump housing liner 38 and the lower edge 33 of the impeller 20. The optimal gap between the impeller 20 and the pump housing liner 38 is in the range 0.05-2 mm.

The pump housing liner 38 has an inner surface 11' that is part of the inner surface 11 of the pump housing 7, and the inner surface 11' of the pump housing liner 38 is essentially straight, seen in the flow direction.

According to the first embodiment of the pump 1, as disclosed in FIGS. 3-5, the pump housing liner 38 is essentially located between the diffuser 9 and the lower edge 33 of the impeller 20.

According to the various embodiments of the present invention, the pump housing liner 38 is displaceable in the radial direction in relation to the outer pump housing 7 in order to adjust the transversal alignment between the pump housing liner 38 and the impeller 20. Thereto, the pump housing liner 38 is preferably made of hard-metal, preferably hard-iron, steel, stainless steel, etc., in order to resist wear and corrosion.

According to the various embodiments of the present invention, the upper end of the pump housing liner 38 is in telescopic arrangement with the diffuser 9, and/or the lower end of the pump housing liner 38 is in telescopic arrangement with the inlet funnel 8. Said telescopic interfaces allow mutual axial displacement between the pump housing liner 38 and the pump housing 7. Preferably, rubber sealings are arranged in said telescopic interfaces. Thus, the alignment of the pump housing liner 38 with the pump housing 7 is well defined and any tilting of the pump housing liner 38 in relation to the pump housing 7 is prevented.

According to various embodiments, the pump housing liner 38 comprises a radially extending flange 40, that extends in the outward direction in relation to the inner surface 11' of the pump housing liner 38. The diffuser 9 comprises a transversal surface 41 that is located opposite said radially extending flange 40. Preferably, the pump housing liner 38 is connected to the lower end of the diffuser 9 by means of axially adjustable attachment means, that is located at the interface between the radially extending flange 40 of the pump housing liner 38 and the transversal surface 41 of the diffuser 9. The pump housing liner 38 is displaceable in the axial direction in relation to the outer pump housing 7 by means of the axially adjustable attachment means, wherein said axially adjustable attachment means are accessible and manipulatable via openings 42 in the inlet funnel 8.

According to the present invention, the axially adjustable attachment means comprises a plurality of adjustment screws 43 and a plurality of locking screws 44. Preferably the axially adjustable attachment means comprises three to five adjustment screws 43 that are equidistantly located around the centre axis A, and two locking screws 44 per adjustment screw 43, i.e. one on each side seen in the circumferential direction.

Each adjustment screw 43 is in threaded engagement with the diffusor 9 at the transversal surface 41, and the head of the adjustment screw 43 is located between the transversal surface 41 of the diffuser 9 and the radially extending flange 40 of the pump housing liner 38. The adjustment screw 43 is configured to define the minimum distance between the transversal surface 41 and the radially extending flange 40, i.e. the axial location of the pump housing liner 38 in relation to the pump housing 7. The adjustment screw 43 is accessible and manipulatable via an opening 45 in the radially extending flange 40 of the pump housing liner 38. The opening 45 in the radially extending flange 40 is aligned with the corresponding opening 42 in the inlet funnel 8.

Each locking screw 44 is in threaded engagement with the diffusor 9 at the transversal surface 41, and the head of the locking screw 44 is configured to define the maximum distance between the transversal surface 41 and the radially extending flange 40, i.e. the axial location of the pump housing liner 38 in relation to the pump housing 7. Thus, the radially extending flange 40 of the pump housing liner 38 is clamped between the head of the adjustment screw 43 and the head of the locking screw 44.

The inlet funnel 8 and/or the pump housing liner 38 may be detached from the diffusor 9 by unscrewing the adjustment screws 43 and/or the locking screws 44. Thus, when unscrewing the adjustment screws 43 and/or the locking screws 44, their heads will push the inlet funnel 8 and/or the pump housing liner 38 away from the diffusor 9. According to alternative embodiments, separate means are used to detach/demount the inlet funnel 8 and/or the pump housing liner 38 from the diffusor 9.

Figure 7:
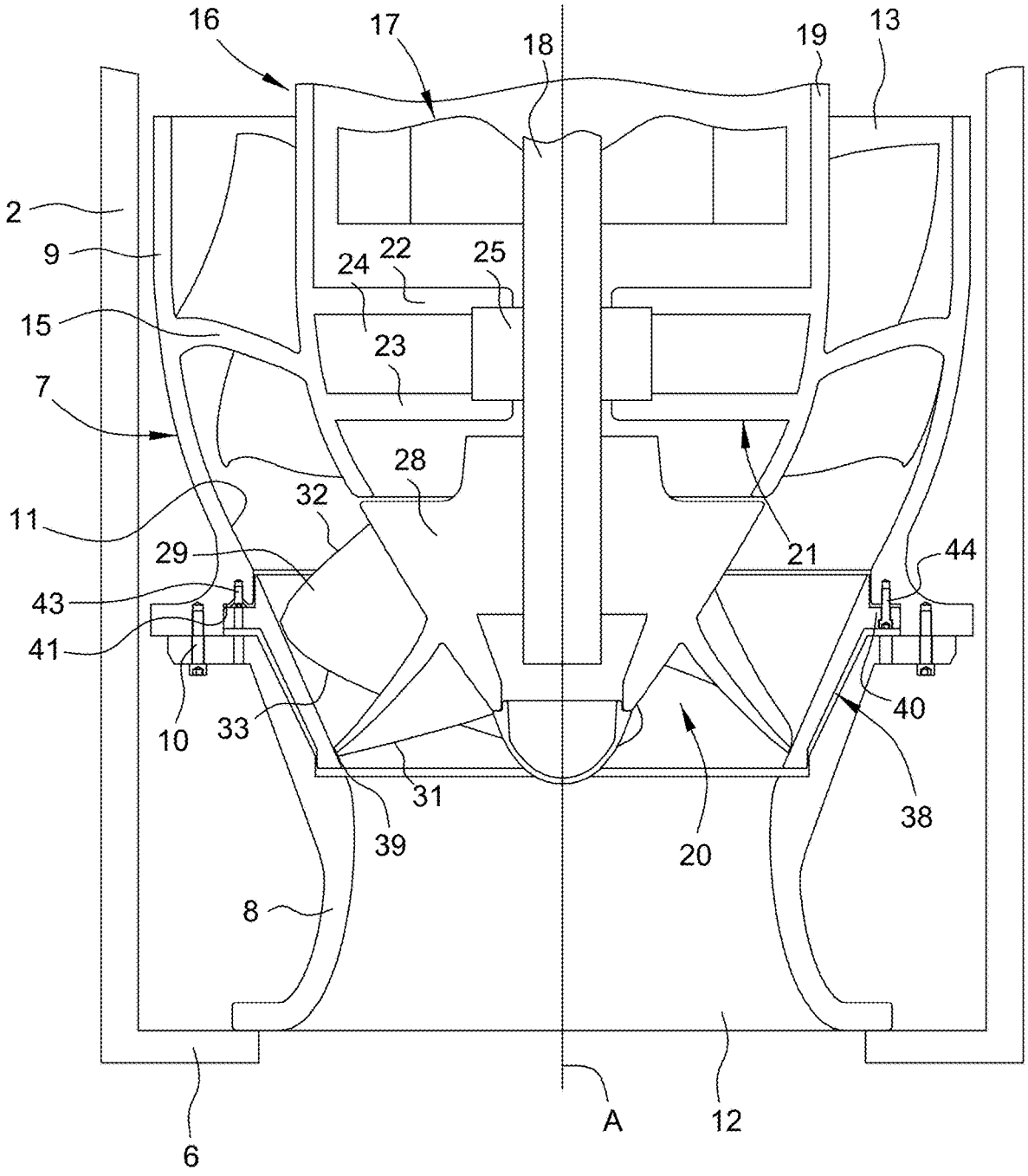
FIG. 7 is a schematic cross-sectional side view of a part of the semi-axial centrifugal pump according to a second embodiment.

Reference is now made to FIG. 7 disclosing a schematic cross-sectional side view of the lower part of the semi-axial centrifugal pump 1 according to a second embodiment and of the lower end of the column 2, i.e. parts of the pump 1 and the column 2 are removed. Only structural differences in relation to the first embodiment is described. According to the second embodiment of the pump 1, as disclosed in FIG. 7, the pump housing liner 38 is essentially located between the inlet funnel 8 and the lower edge 33 of the impeller 20.

The adjustment of the axial position of pump housing liner 38 in relation to the pump housing 7 and the impeller 20 comprises a set of steps, with reference to the disclosed first and second embodiment of the pump 1.

The first step is to move the head of the attachment screws 43 towards the transversal surface 41. The second step is to tighten the locking screws 44 until the pump housing liner 38 abuts the lower edge 33 of the blades 29 of the impeller 20. Since the pump housing liner 38 is rather light the operator feels when there is abutment between the pump housing liner 38 and the impeller 20. Preferably the locking screws 44 are tightened using a predetermined torque. The third step entails that all locking screws 44 are loosen a predetermined amount, i.e. for instance quarter of a turn or half a turn, such that the pump housing liner 38 is displaced away from the impeller 20. The amount is dependent on the pitch of the locking screw 44 and the inclination of the inner surface 11' of the pump housing liner 38, and the requested gap 39. The fourth step is to move the head of the attachment screws 43 away from the transversal surface 41 and into contact with the radially extending flange 40 of the pump housing liner 38. The operator feels when there is abutment between the attachment screws 43 and the pump housing liner 38. Preferably the attachment screws 43 are tightened against the radially extending flange 40 using a predetermined torque. The fifth step is to tighten the locking screws 44 using a predetermined torque.

It shall be pointed out that the axially adjustable attachment means may be constituted by any other member(s) that is configured and capable of fixating the pump housing liner 38 in relation to the pump housing 7. Such as radially extending pins having a cam surface located at the interface between the transversal surface 41 and the radially extending flange 40, wherein the pins are accessible and manipulatable from the outside of the inlet funnel 8. According to another embodiment, the pump housing liner 38 is in threaded engagement with the pump housing 7, whereupon turning of the pump housing liner 38 entails that the location in the axial direction is adjusted. The turning of the pump housing liner 38 may be accomplished using a worm gear arrangement accessible and manipulatable from the outside of the inlet funnel 8.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims. Any subject matter falling outside the scope of the claims is provided for information purposes and for placing the invention into a relevant context.

It shall also be pointed out that all information about/concerning terms such as above, under, upper, lower, etc., shall be interpreted/read having the equipment oriented according to the figures, having the drawings oriented such that the references can be properly read. Thus, such terms only indicate mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

The invention claimed is:

1. A submersible semi-axial centrifugal pump for installation in a column and configured for pumping liquid comprising solid matter, comprising:

an outer pump housing having an axial inlet and an axial outlet, and an inner pump core arrangement, comprising:

a stationary drive unit surrounded at least partly by the pump housing, a semi-axial open centrifugal impeller that is suspended from the drive unit and located adjacent the inlet of the pump housing, and a plurality of guide vanes extending between and connecting the pump housing and the drive unit of the pump core arrangement, wherein the impeller comprises a hub and at least two spirally swept blades connected to the hub and extending in the radial direction from the hub, wherein the hub is essentially cone-shaped tapering towards the inlet of the pump housing, each blade comprising a leading edge facing the inlet of the pump housing, a trailing edge facing the outlet of the pump housing and a lower edge, wherein the lower edge extends from the leading edge to the trailing edge, wherein the outer pump housing comprises:

a diffuser, connected to the stationary drive unit via the radially extending guide vanes, wherein the diffuser comprises the outlet of the pump, and an inlet funnel, fixedly connected to the diffuser, wherein the inlet funnel comprises the inlet of the pump, wherein the semi-axial centrifugal pump comprises a pump housing liner, located between the outer pump housing and the lower edge of the impeller, wherein the pump housing liner is displaceable in the axial direction in relation to the outer pump housing in order to adjust a radial gap between the pump housing liner and the lower edge of the impeller, wherein the pump housing liner comprises a radially extending flange and the diffuser comprises a transversal surface located opposite said radially extending flange, the pump housing liner being displaceable in the axial direction in relation to the outer pump housing by means of axially adjustable attachment means that are in threaded engagement with the diffusor at the transversal surface and that are accessible and manipulatable via openings in the inlet funnel, the adjustable attachment means comprising a plurality of adjustment screws and a plurality of locking screws, wherein the radially extending flange is clamped between the head of the adjustment screws and the head of the locking screws, wherein the maximum distance between the transversal surface and the radially extending flange is defined by the locking screws, and wherein the minimum distance between the transversal surface and the radially extending flange is defined by the adjustment screws.

2. The submersible semi-axial centrifugal pump according to claim 1, wherein the pump housing liner is located between the diffuser and the lower edge of the impeller.

3. The submersible semi-axial centrifugal pump according to claim 1, wherein the pump housing liner is located between the inlet funnel and the lower edge of the impeller.

4. The submersible semi-axial centrifugal pump according to claim 1, wherein the pump housing liner is displaceable in the radial direction in relation to the outer pump housing in order to adjust the transversal alignment between the pump housing liner and the impeller.

5. The submersible semi-axial centrifugal pump according to claim 1, wherein the pump housing liner is made of hard-metal, preferably hard-iron.

6. The submersible semi-axial centrifugal pump according to claim 1, wherein the upper end of the pump housing liner is in telescopic arrangement with the diffuser.

7. The submersible semi-axial centrifugal pump according to claim 1, wherein the lower end of the pump housing liner is in telescopic arrangement with the inlet funnel.

8. The submersible semi-axial centrifugal pump according to claim 1, wherein the pump housing liner is connected to the lower end of the diffuser by means of axially adjustable attachment means.

9. The submersible semi-axial centrifugal pump according to claim 1, wherein the optimal gap between the impeller and the pump housing liner is in the range 0.05-2 mm.

* * * * *